US007490786B2

(12) United States Patent
Matlin et al.

(10) Patent No.: US 7,490,786 B2
(45) Date of Patent: Feb. 17, 2009

(54) SHREDDER WITH STACK THICKNESS GAUGE

(75) Inventors: Tai Hoon Kim Matlin, Round Lake Beach, IL (US); Devin Lee Moore, Decatur, GA (US); Matthew Luis Rivera, Mableton, GA (US); Nheeda C. Enriquez, Jersey City, NJ (US)

(73) Assignee: Fellowes, Inc., Itasca, IL (US)

( * ) Notice: Subject to any disclaimer, the term of this patent is extended or adjusted under 35 U.S.C. 154(b) by 330 days.

(21) Appl. No.: 11/324,782

(22) Filed: Jan. 4, 2006

(65) Prior Publication Data

US 2007/0007373 A1 Jan. 11, 2007

Related U.S. Application Data

(60) Provisional application No. 60/640,999, filed on Jan. 4, 2005.

(51) Int. Cl.
*B02C 25/00* (2006.01)

(52) U.S. Cl. ..... 241/36; 241/100; 241/236

(58) Field of Classification Search ..... 241/36, 241/100, 236, 101.2
See application file for complete search history.

(56) References Cited

FOREIGN PATENT DOCUMENTS

| | | |
|---|---|---|
| EP | 855 221 A | 7/1998 |
| JP | 6-277548 | 10/1994 |
| JP | 7-299377 | 11/1995 |

OTHER PUBLICATIONS

International Search Report for PCT/US2006/000010 dated May 11, 2006.
Written Opinion for PCT/US2006/000010.

*Primary Examiner*—Mark Rosenbaum
(74) *Attorney, Agent, or Firm*—Pillsbury Winthrop Shaw Pittman LLP

(57) ABSTRACT

The present invention relates to a shredder with a stack thickness gauge.

11 Claims, 8 Drawing Sheets

SHREDDER WITH STACK THICKNESS GAUGE

This application claims priority to U.S. Provisional Application No. 60/640,999, filed Jan. 4, 2005, the entire contents of which are hereby incorporated by reference.

FIELD OF THE INVENTION

The present invention relates to shredders for destroying articles, such as documents, CDs, etc.

BACKGROUND OF THE INVENTION

Shredders are well known devices for destroying substrate articles, such as documents, CDs, floppy disks, etc. Typically, users purchase shredders to destroy sensitive articles, such as credit card statements with account information, documents containing company trade secrets, etc.

Typically, a shredder has a shredder mechanism contained within a housing, and the housing has a feed opening enabling substrates to be fed into the shredder mechanism. Often, users feed substrates into the shredding mechanism in stacks, rather than by individual pages. If the user feeds a stack that exceeds the shredding mechanism's maximum capacity (i.e. the maximum stack thickness it can handle), the shredding mechanism may become jammed, forcing the user to reverse the mechanism and feed the substrates in two or more smaller stacks.

The present invention endeavors to provide a shredder with a feature that helps the end user determine whether the stack he/she is feeding is within the shredder mechanism's capacity.

SUMMARY OF THE INVENTION

One aspect of the present invention provides a shredder for shredding substrates with a stack thickness gauge. The shredder comprises a housing, a shredder mechanism, and the stack thickness gauge. The shredder mechanism is received in the housing and includes a motor and cutter elements. The shredder mechanism enables substrates to be shredded to be fed into the cutter elements, and the motor is operable to drive the cutter elements in a shredding direction so that the cutter elements shred the substrates fed therein. The housing has a feed opening enabling the substrates to be shredded to be fed into the cutter elements. The stack thickness gauge has a substrate receiving opening configured to receive an edge portion of a stack of substrates therein. The substrate receiving opening is less than or equal to a maximum thickness of a stack of substrates that the shredder mechanism is capable of shredding.

Other objects, features, and advantages of the present invention will become apparent from the following detailed description, the accompanying drawings, and the appended claims.

DETAILED DESCRIPTION OF THE ILLUSTRATED EMBODIMENTS

Figure 1:
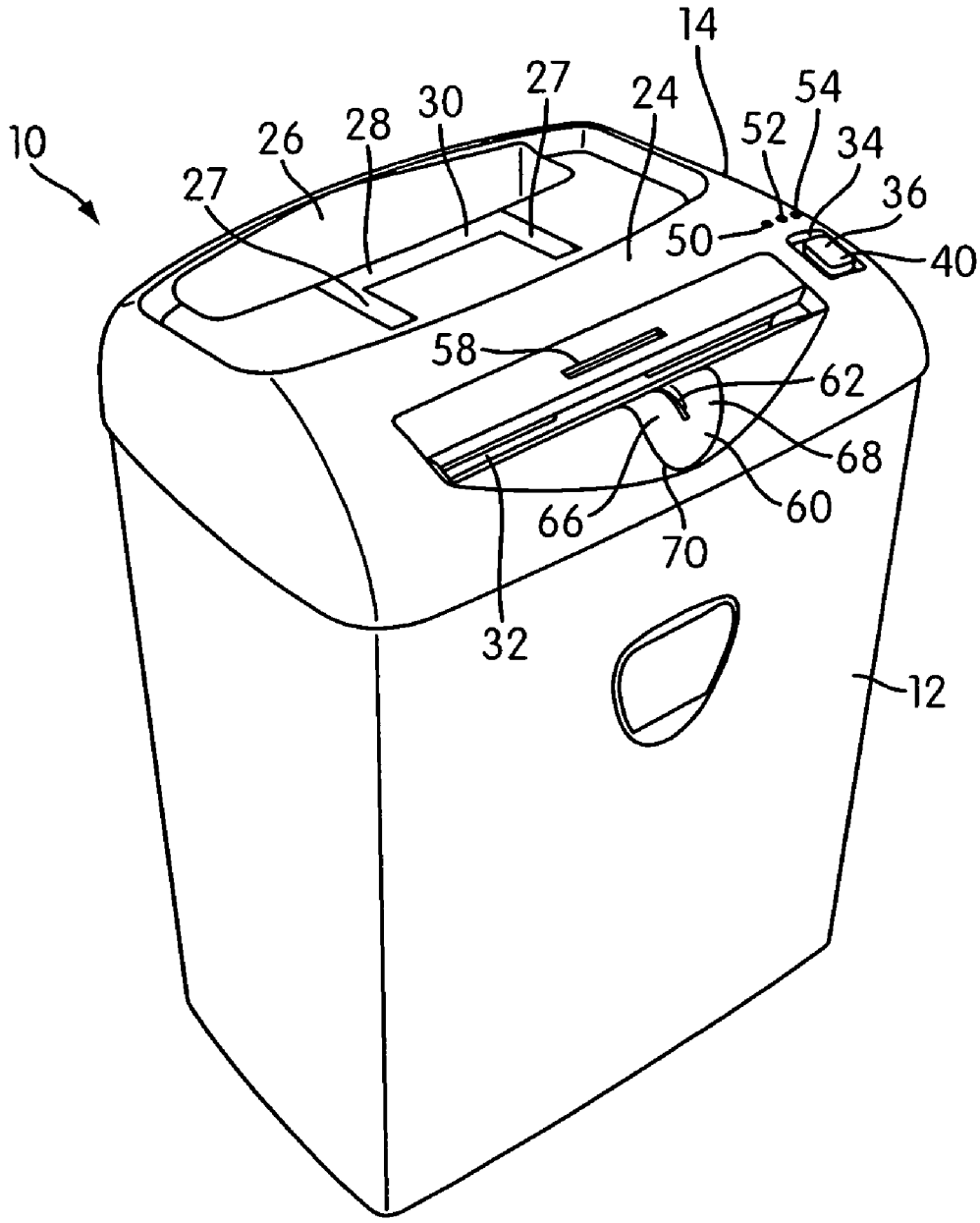
FIG. 1 is a perspective view of a shredder constructed in accordance with an embodiment of the present invention.

FIGS. 1-4 illustrate an embodiment of a shredder constructed in accordance with one embodiment of the present invention. The shredder is generally indicated at 10. The shredder 10 sits atop a waste container, generally indicated at 12, which is formed of molded plastic or any other material. The shredder 10 illustrated is designed specifically for use with the container 12, as the shredder housing 14 sits on the upper periphery of the waste container 12 in a nested relation. However, the shredder 10 may be of the type provided with an adaptable mount for attachment to a wide variety of containers, or may be part of a freestanding frame with a compartment that receives a removable waste container. Generally speaking, the shredder 10 may have any suitable construction or configuration and the illustrated embodiment is not intended to be limiting in any way.

The shredder 10 includes a shredder mechanism 16 including an electrically powered motor 18 and a plurality of cutter elements 20. The cutter elements 20 are mounted on a pair of parallel rotating shafts (not shown). The motor 18 operates using electrical power to rotatably drive the shafts and the cutter elements 20 through a conventional transmission (not shown) so that the cutter elements 20 shred articles fed therein. The shredder mechanism 16 may also include a subframe for mounting the shafts, the motor 18 and the transmission. The operation and construction of such a shredder mechanism 16 are well known and need not be described herein in detail. The shredder mechanism 16, motor 18, and cutter elements are represented schematically in FIG. 8. Generally, any suitable shredder mechanism known in the art or developed hereafter may be used. For example, reference may be made to U.S. application Ser. Nos. 10/828,254; 10/815,761 and 10/347,700; and U.S. Pat. Nos. 6,260,780; 5,961,059; 5,961,058; 5,954,280; 5,829,697; 5,826,809; 5,799,887; 5,676,321; 5,655,725; 5,636,801; 5,511,732; 5,295,633 and 5,071,080 for details of various shredder mechanisms. Each of these patents and applications is incorporated into the present application by reference in their entirety.

The shredder 10 also includes the shredder housing 14, mentioned above. The shredder housing 14 includes a top wall 24 that sits atop the container 12. The top wall 14 is molded from plastic and a waste opening 26 is located at a rear portion thereof. The opening 26 allows waste to be discarded into the container 12 without being passed through the feed opening 32 and the shredder mechanism 16, as discussed below. As an optional feature, this opening 26 may be provided with a lid, such as a pivoting lid, that opens and closes the opening 26. However, this opening is optional and may be omitted entirely.

Additionally, the top wall 24 has a handle 28 pivotally connected to it and adjacent the waste opening 26. The handle 28 is pivoted at the ends of its legs 27 and can be pivoted upwardly so that its hand grip portion 30 can be grasped. This makes it easier for the user to lift the shredder mechanism 16 off the waste container 12. The handle 30 is entirely optional. In the illustrated embodiment, the top wall 24 has a relatively flat upper area where the handle 28 and waste opening 26 are located, and curves downwardly at its front, side, and rear areas. However, the shredder housing 14 and its top wall 24 may have any suitable construction or configuration.

The top wall 24 has a generally laterally extending feed opening 32 extending generally parallel and above the cutter elements 20. The feed opening 32, often referred to as a throat, enables the articles being shredded to be fed into the cutter elements 20. The opening 32 may have any configuration.

The top wall 24 also has a switch recess 34 with an opening (not shown) therethrough. A main switch 36 includes a switch module 38 mounted to the top wall 24 underneath the recess 34 by fasteners, and a movable manually engageable portion 40. Movement of the manually engageable portion 40 moves the switch module between its states.

Figure 8:
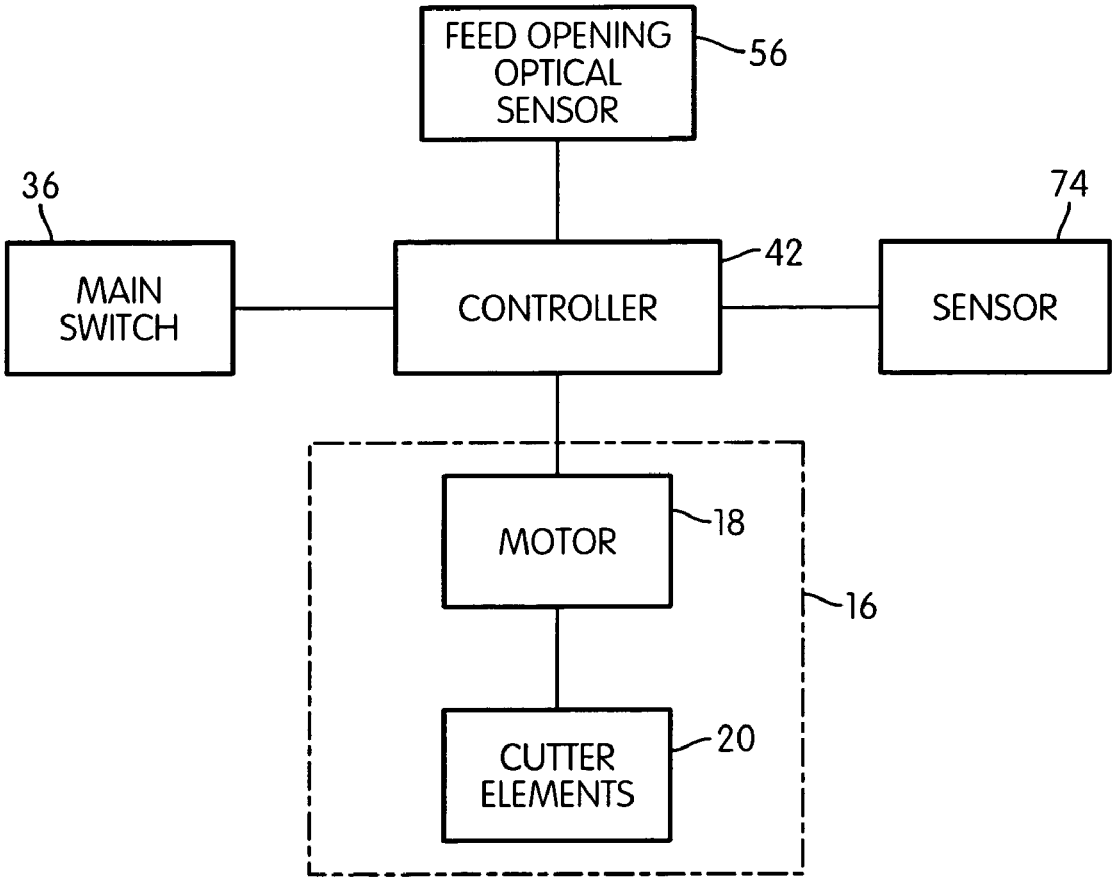
FIG. 8 is a schematic block diagram of various operational components of a shredder.

In the illustrated embodiment, the switch module 38 is communicated to a controller 42, which is shown as including a printed circuit board 44. Typically, a power supply (not shown) is connected to the controller 42 by a standard power cord 46 with a plug 48 on its end that plugs into a standard AC outlet. The controller 42 is likewise communicated to the motor 18. When the main switch 36 is moved to an on position, the controller 42 can send an electrical signal to the drive the motor 18 so that it rotates the cutting elements 20 in a shredding direction, thus enabling articles fed in the feed opening 26 to be shredded. The switch 36 may also be moved to an off position, which causes the controller 42 to stop operation of the motor 18. The switch module 38 contains appropriate contacts for signalling the position of the switch's manually engageable portion 40. The motor 18, controller 42, main switch 36, and cutters 20 are shown schematically in FIG. 8. Although FIG. 8 shows a sensor 74, that component can be ignored, as it is not used in the embodiments of FIGS. 1-4.

As an option, the switch 36 may also have a reverse position that signals the controller 42 to operate the motor 18 in a reverse manner. This would be done by using a reversible motor and applying a current that is of a reverse polarity relative to the on position. The capability to operate the motor 18 in a reversing manner is desirable to move the cutter elements 20 in a reversing direction for clearing jams. To provide the on, off, and reverse positions, the switch 36 used may be a three position rocker switch (or a two position switch if only two positions are used). Also, the switch 36 may be of the push switch type that is simply depressed to cycle the controller through the three (or two) conditions.

Generally, the construction and operation of the switch 36 and controller 42 for controlling the motor 18 are well known and any construction for these may be used. For example, a touch screen switch, a membrane switch, or a toggle switch are other examples of switches that may be used. Also, the switch need not have distinct positions corresponding to on/off/reverse, and theses conditions could be states selected in the controller by operation of the switch. The particular condition (e.g., on, off, reverse) could be signalled by the lights 50, 52, 54 (discussed below), on a screen, or otherwise.

To assist the user in visually verifying the operational status of the shredder 10, three optional lights 50, 52, 54 are provided. Light 50 to the left corresponds to the on position of the switch 36, which means that the shredder mechanism 16 is on and ready to shred. Light 52 in the middle correspond to the off position of the switch 36, and indicates that the shredder 10 is plugged in and ready to be activated. Light 54 to the right corresponds to the reverse position of the switch 36, and indicates that the shredder mechanism 16 is operating in reverse. Any type of lights, such as LEDs may be used, and all or some of the lights can be eliminated.

An optical sensor 56 may be provided in the feed opening 32. When the switch 36 is in its on position, the controller 42 may be configured to operate the motor 18 to drive the cutter elements 20 in the shredding direction only upon the optical sensor 56 being triggered. Specifically, the optical sensor 56 includes a transmitter and a receiver located within the feed opening 32.

The transmitter emits a light beam to the receiver across the opening 32. When a paper or other article is inserted into the opening, it will interrupt the light beam, and this is sensed by the receiver, which is communicated to the controller 42. Based on this, assuming that the switch 36 is in the on position, the controller 42 then activates the motor 18 to drive the cutter elements 20 in the shredding direction. The use of such a sensor is desirable because it allows the user to ready the shredder 10 by moving the switch 36 to its on position, but the controller 42 will not operate the shredder mechanism 16 to commence shredding until the sensor 56 detects the presence of one or more substrates in the feed opening 32. Once the substrates have passed into the shredding mechanism 16 beyond the sensor 56, the controller 42 will then stop the shredding mechanism 16, as that corresponds to the substrates having been fully fed and shredded. Typically, a slight delay, such as 3-5 seconds, is used before stopping the shredding mechanism 16 to ensure that the substrates have been completely shredded and discharged from the shredder mechanism 16. This is beneficial because it allows the user to perform multiple shredding tasks without having the shredder mechanism 16 operating, and making noise, between tasks. It also reduces wear on the shredder mechanism 16, as it will only operate when substrates are fed therein, and will not continually operate. Other sensors besides an optical sensor may be used, but an optical sensor is preferred because it has no mechanical parts and is less susceptible to wear.

As an optional feature, a narrow opening 58 may be provided adjacent the feed opening 32 for insertion of more rigid articles, such as CDs and credit cards. As can be seen in the drawings, this opening 58 is much narrower in the transverse direction of the shredder 10 than the feed opening 32. Also, it has a smaller width to restrict the number of articles that can be inserted, thus preventing overloading and jamming. This opening 58 leads into the feed opening 32, and articles inserted through the opening 58 will trigger the same optical sensor 56 as discussed above. While it is possible for a user to insert such articles through the larger feed opening 36, the smaller size of opening 58 typically encourages users to use it for feeding such articles.

To help prevent the user from feeding a stack of substrates that is overly thick into the shredder mechanism 16, a stack thickness gauge 60 is provided. The stack thickness gauge 60 has a substrate receiving opening 62 configured to receive an edge portion of a stack of substrates 64 therein. In the illustrated embodiment, the stack thickness gauge includes two upwardly extending structures 66, 68 spaced apart to define the opening 64. These structures 66, 68 are part of an integral molded plastic part that snaps into a recess 70 on a front portion of the top wall 24 adjacent the feed opening 32. The snap-fit projections 72 for securing the gauge 60 in the recess 70 can be seen in FIG. 4, and corresponding receiving holes are provided in the recess 70. The gauge 60, however, may have any construction. For example, it may be constructed as an integrated part of the housing 14, instead of as a part that is separate and attachable to it. Likewise, it may be placed in another location, and its opening 62 may have a different orientation, such as horizontal or at an angle.

The width of the substrate opening 62 is less than or equal to a maximum thickness of a stack of substrates that the shredder mechanism 16 is capable of shredding. This width will vary from shredder to shredder, and depends on factors such as cutter efficiency and motor power. However, any given shredder is limited as to how thick of a stack of substrates it can handle at one time. Above this limit, the shredder mechanism 16 is liable to jam, requiring the user to reverse the shredder mechanism 16 or otherwise remove the substrates from the mechanism 16 for re-feeding in smaller stacks.

Figure 2:
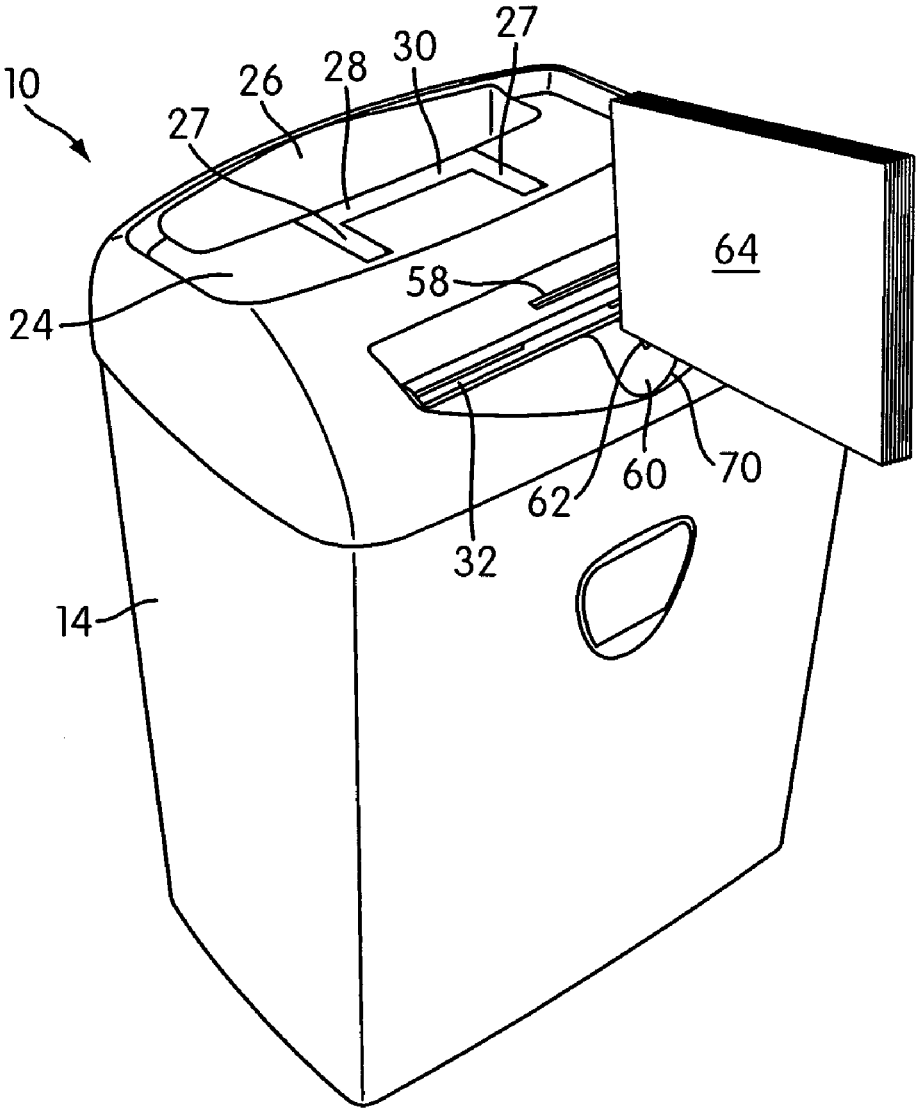
FIG. 2 is a perspective view similar to FIG. 1, showing a stack of documents that is too thick to be inserted into a thickness gauge on the shredder.
Figure 3:
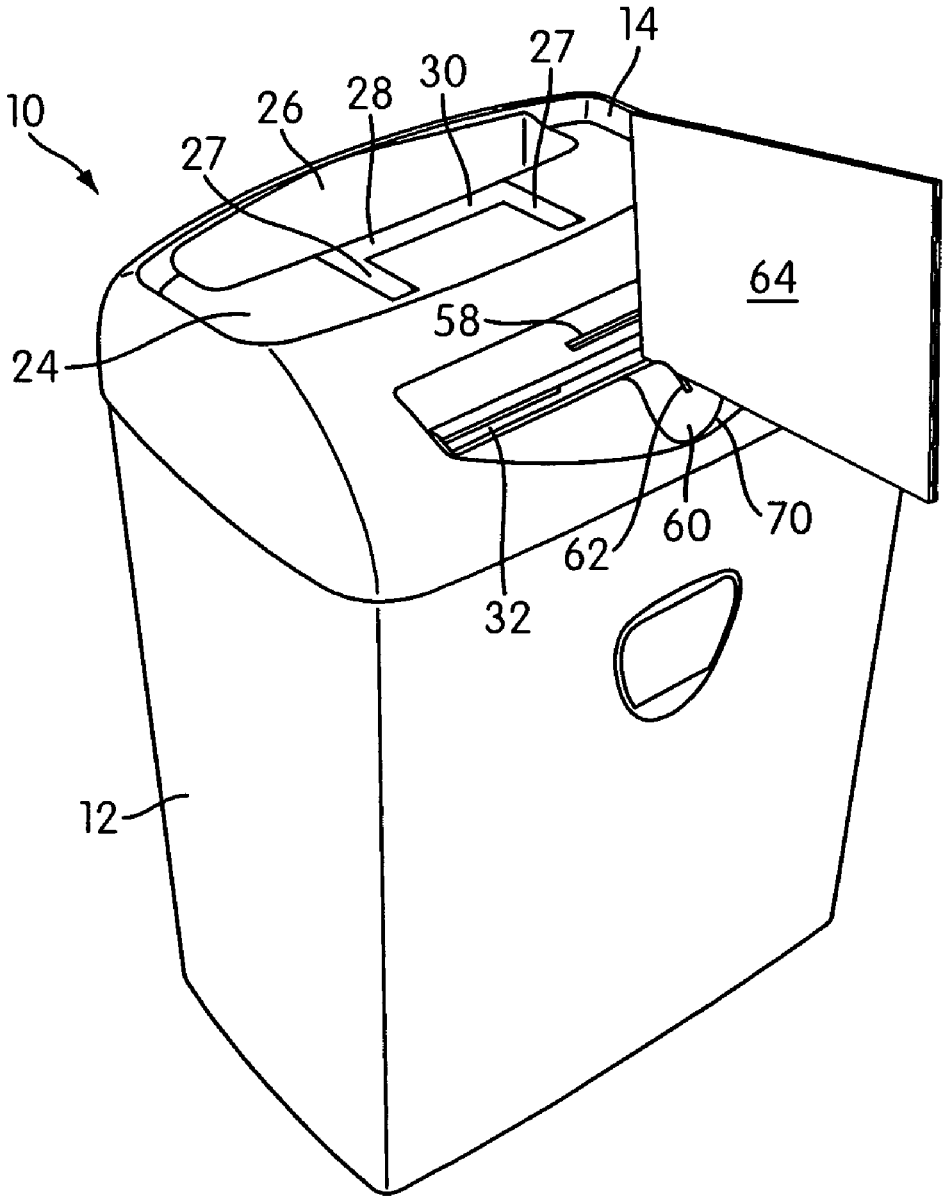
FIG. 3 is a perspective view similar to FIG. 2, but with a thinner stack of documents inserted into the thickness gauge.
Figure 4:
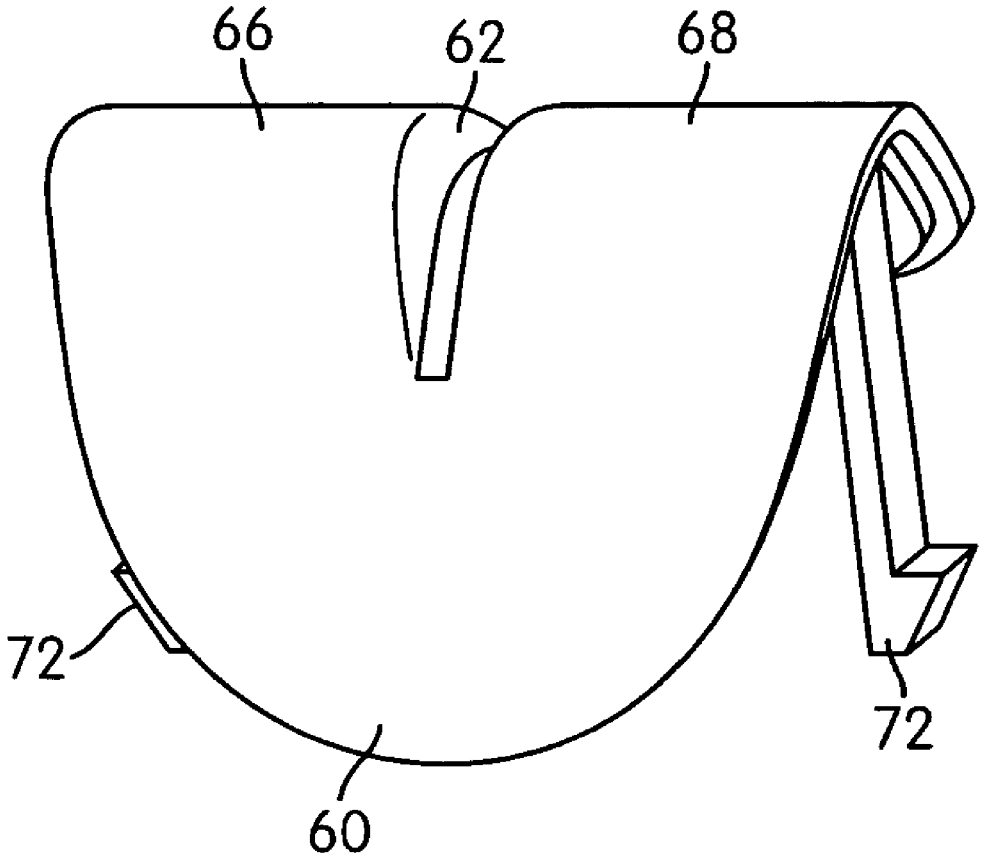
FIG. 4 is a close-up perspective view of the thickness gauge.

By providing the stack thickness gauge 60, the user can verify whether the stack he/she desires to shred is within or above the capability of the shredder mechanism 16. As can be seen in FIG. 2, if the stack 64 is too thick, the user will not be able to insert the edge portion of the stack into the substrate receiving opening 62, indicating that the stack thickness needs to be reduced. Likewise, as can be seen in FIG. 3, if the stack 64 is thinner than the width of the opening 62, it can be inserted therein, indicating that the stack 64 can be fed into the shredder mechanism 16 as is.

Typically, the width of the opening 62 will be selected based on the capacity of the shredder mechanism 16 to handle a stack of a given type of substrate. For example, most shredders are used to shred paper, and thus in most instances the thickness of opening 62 will be based on the maximum thickness for a stack of paper that the shredder mechanism 16 can handle. For specialized shredders dedicated to other substrates, the width of opening 62 may be based on the shredder mechanism's capacity to handle a relevant substrate other than paper.

Figure 5:
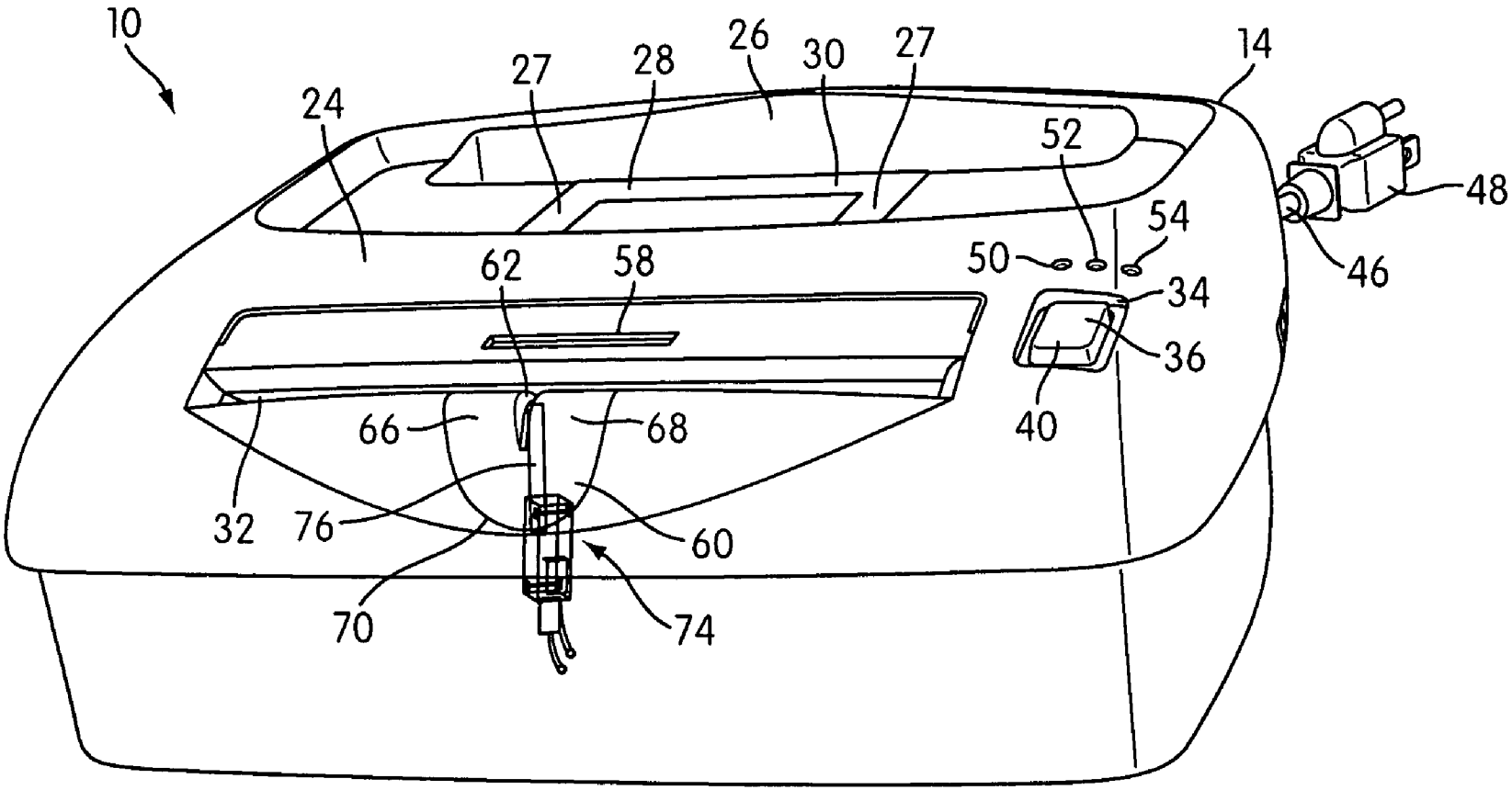
FIG. 5 is a perspective view of an alternative embodiment, wherein a sensor in the form of a switch lever is associated with the thickness gauge.
Figure 6:
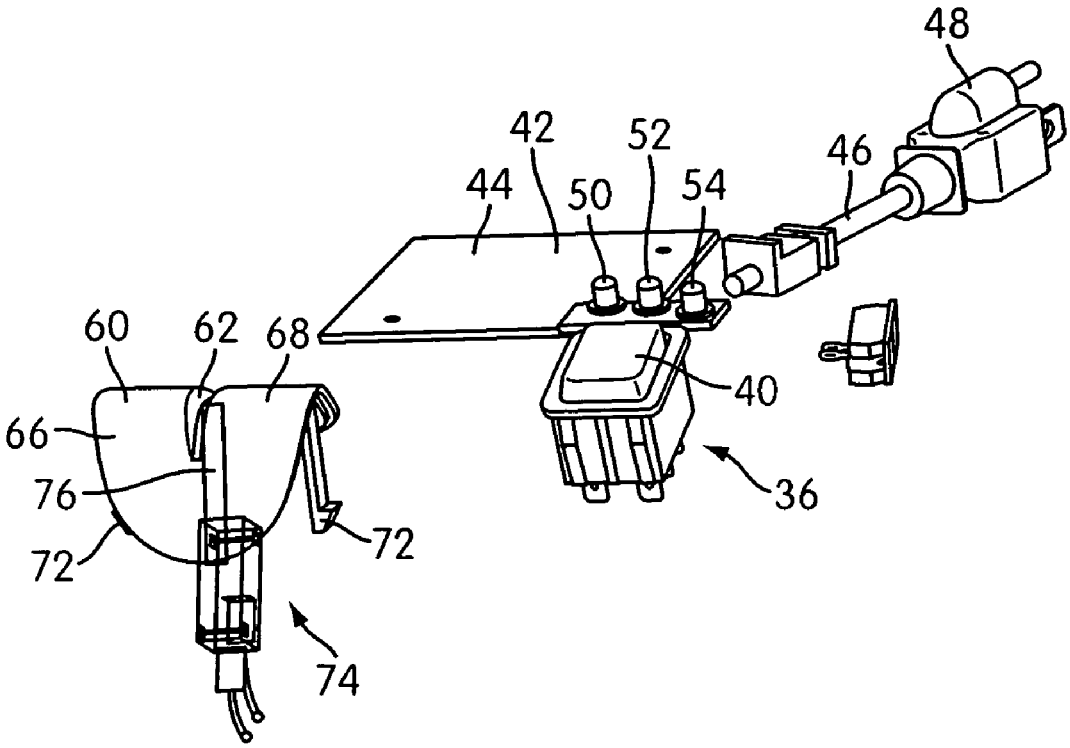
FIG. 6 is a perspective view of isolated components of the shredder of FIG. 5.
Figure 7:
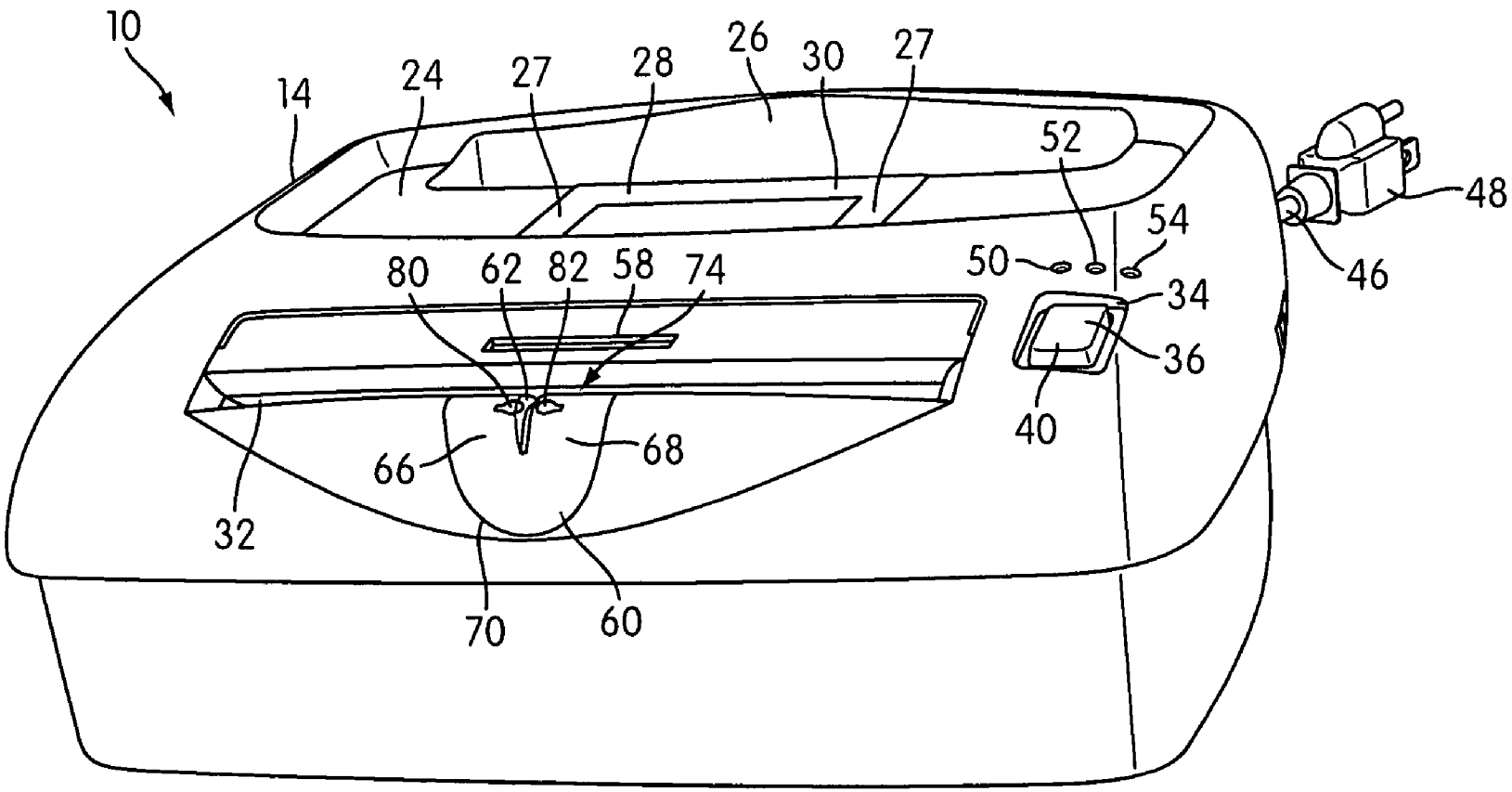
FIG. 7 is a perspective view of another alternative embodiment, wherein a sensor in the form of an optical sensor is associated with the thickness gauge.

In the embodiments of FIGS. 5-7, the shredder 10 further comprises a sensor 72 associated with the stack thickness gauge 60. In each of these embodiments, the shredder 10 illustrated has the same basic construction, with the exception of the provision of a sensor 74 and its associated components. Thus, the same reference numbers will be used for common components.

In each of these embodiments, the sensor 74 is operable to detect receipt of the edge portion of the stack 64 in the substrate receiving opening 62. This detection is transmitted to the controller 42. The controller 42 enables activation of the motor 18 to drive the cutter elements 18 in the shredding direction only upon the sensor 74 detecting receipt of the stack's edge portion in the substrate receiving opening 62.

By "enabling activation," it is meant that (a) the controller 42 will actually activate the shredder mechanism's motor 18 to drive the cutter elements 20 in the shredding direction; or (b) where a sensor is used in the feed opening 32 (e.g., optical sensor 56), the controller will be ready to activate the shredding mechanism's motor 18 to drive the cutter elements 20 in the shredding direction upon triggering of the sensor in the feed opening 32 as discussed above. Where main switch 36 and a sensor 56 associated with the feed opening 32 are used, the controller 42 will be ready to activate the shredder mechanism 16 to drive the cutter elements 20 in the shredding direction only upon the switch 36 being operated to an on condition first and then the sensor 74 being triggered by the edge of a stack. Then, the controller 42 will activate the shredder mechanism's motor 18 upon the feed opening sensor 56 detecting receipt of the stack in the feed opening 32. Preferably, the controller 42 will only enable such activation of the motor for a limited duration of time (e.g., 5-15 seconds) after triggering the sensor 74. This duration of time is selected to be sufficient for the user to feed the stack into the feed opening 32 after triggering the sensor 74, but prevents the controller 42 from leaving activation of the motor enabled if the stack is not fed. Thus, if a user attempts to use the shredder 10 without first inserting a stack 64 in the stack thickness gauge for detection by the sensor 74, the controller 42 will not enable activation of the motor 18 irrespective of whether the switch 36 is in the on position and/or a sensor in the feed opening 32 has been triggered. However, if the user does first insert the stack 64 in the opening 62 for detection by the sensor 74, then the controller 42 will enable activation of the motor 18. Thus, with the switch 36 in its on position, shredding will proceed as normal as the stack is fed into the feed opening 32 and trigger sensor 56. This forces the user to divide a large amount of substrates into small enough stacks for insertion in the substrate receiving opening 62.

In some embodiments, it is possible to use the sensor 74 as a substitute for the switch's on position. That is, instead of using a main switch 36, the sensor 74 could be used alone to signal the controller 42 to enable activation of the shredder mechanism 16. If a reversing capability is desired, a separate switch similar to switch 36 could be provided to signal reversing of the shredder mechanism 16 to the controller 42. Preferably, the sensor 74 in such an embodiment would be used in conjunction with a sensor associated with the feed opening 32, such as optical sensor 56. When the feed opening sensor is not included, the controller 42 would activate the shredder mechanism 16 to drive the cutter elements 20 in the shredding direction for a period of time (e.g., 10-30 seconds only), upon the sensor 74 detecting receipt of the stack's edge portion in the substrate receiving opening 62. Likewise, when the feed opening sensor is used, the controller 42 would be ready to activate the shredder mechanism's motor 18 to drive the cutter elements 20 in the shredding direction only upon the sensor 74 detecting receipt of the stack's edge portion in the substrate receiving opening 62, and then will activate the shredding mechanism's motor 18 upon the feed opening sensor detecting receipt of the stack feed opening 32.

In the embodiment of FIGS. 5 and 6, the sensor 74 includes a switch lever 76 positioned in the substrate receiving opening 62. The sensor 74 detects receipt of the stack's edge portion by it moving the lever 76. Any suitable arrangement for detecting movement of the lever 76, such as contacts that open or close upon such movement, may be used.

In the embodiment of FIG. 7, the sensor 74 is an optical sensor 78 comprising a transmitter 80 on one side of the substrate receiving opening 62 and a receiver 82 on the other side of the substrate receiving opening 62. The transmitter 80 transmits electromagnetic radiation, such as a light or IR beam to the receiver 82, which is communicated to the controller 42. The optical sensor 78 detects receipt of the stack's edge portion in the substrate receiving opening 62 by the edge portion interrupting the electromagnetic radiation transmitted to the receiver 82. The construction of such optical sensors 78 is well-known and need not be detailed in this application.

The optical sensor 78 is preferred over the use of a switch lever 76 because it is less susceptible to failure, and is sensitive to very thin substrates that might not trigger the switch lever 76. To solve this, the switch lever 76 could be made more sensitive, but that makes it more susceptible to failure.

The foregoing illustrated embodiment has been provided to illustrate the structural and functional principles of the present invention and is not intended to be limiting. To the contrary, the present invention is intended to encompass all modifications, alterations and substitutions within the spirit and scope of the appended claims.

What is claimed:

1. A shredder for shredding substrates, comprising:

a housing;

a shredder mechanism received in the housing and including a motor and cutter elements, the shredder mechanism enabling substrates to be shredded to be fed into the cutter elements and the motor being operable to drive the cutter elements in a shredding direction so that the cutter elements shred the substrates fed therein;

the housing having a feed opening enabling the substrates to be shredded to be fed into the cutter elements; and a stack thickness gauge defining a substrate receiving opening configured to receive an edge portion of a stack of substrates therein, the substrate receiving opening having a width less than or equal to a maximum thickness of a stack of substrates that the shredder mechanism is capable of shredding, a sensor associated with the stack thickness gauge and a controller, the sensor being communicated to the controller, the sensor being operable to detect receipt of the edge portion of the stack of substrates in the substrate receiving opening, the controller enabling activation of the motor to drive the cutter elements in the shredding direction only upon the sensor detecting receipt of the edge portion of the stack of substrates in the substrate receiving opening.

2. A shredder for shredding substrates according to claim 1, wherein the substrate opening has a width less than or equal to a maximum thickness of a stack of paper that the shredder is capable of shredding.

3. A shredder for shredding substrates according to claim 1, wherein the stack thickness gauge comprises two upwardly extending structures spaced apart to define the substrate receiving opening.

4. A shredder for shredding substrates according to claim 1, wherein the motor is an electric motor.

5. A shredder according to claim 1, wherein the controller enables activation of the motor to drive the cutter elements in the shredding direction for a limited duration upon the sensor detecting receipt of the edge portion of the stack of substrates in the substrate receiving opening.

6. A shredder according to claim 1, wherein the sensor is an optical sensor comprising a transmitter on one side of the substrate receiving opening and a receiver on the other side of the substrate receiving opening, the transmitter transmitting electromagnetic radiation to the receiver and the receiver being communicated to the controller, the optical sensor detecting receipt of the edge portion of the stack of substrates in the substrate receiving opening by the edge portion interrupting the electromagnetic radiation transmitted to the receiver.

7. A shredder according to claim 1, wherein the sensor includes a switch lever positioned in the substrate receiving opening, the sensor detecting receipt of the edge portion of the stack of substrates by the edge portion moving the switch lever.

8. A shredder according to claim 1, further comprising a sensor associated with the feed opening, the sensor associated with the feed opening being communicated to the controller, the sensor associated with the feed opening being operable to detect receipt of the stack of substrates in the feed opening, the controller activating the motor to drive the cutter elements in the shredding direction only upon the sensor associated with the stack thickness gauge detecting receipt of the edge portion of the stack of substrates in the substrate receiving opening and the sensor associated with the feed opening then detecting receipt of the stack of substrates in the feed opening.

9. A shredder according to claim 1, further comprising a main switch communicated to the controller, the controller being operable to enable activation of the motor to drive the cutter elements in the shredding direction only upon the switch being operated to an on condition and the sensor associated with the stack thickness gauge then detecting receipt of the edge portion of the stack of substrates in the substrate receiving opening.

10. A shredder according to claim 9, further comprising a sensor associated with the feed opening, the sensor associated with the feed opening being communicated to the controller, the sensor associated with the feed opening being operable to detect receipt of the stack of substrates in the feed opening, the controller activating the motor to drive the cutter elements in the shredding direction only upon the switch being operated to the on condition, the sensor associated with the stack thickness gauge then detecting receipt of the edge portion of the stack of substrates in the substrate receiving opening, and the sensor associated with the feed opening then detecting receipt of the stack of substrates in the feed opening.

11. A shredder according to claim 1, wherein the controller activates the motor to drive the cutter elements in the shredding direction upon the sensor detecting receipt of the edge portion of the stack of substrates in the substrate receiving opening.

* * * * *